US011846410B2

(12) United States Patent
Li et al.

(10) Patent No.: US 11,846,410 B2
(45) Date of Patent: Dec. 19, 2023

(54) SUPPORT ASSEMBLY AND ILLUMINATION SYSTEM

(71) Applicant: HLI SOLUTIONS, INC., Beachwood, OH (US)

(72) Inventors: Yong Li, ShangHai (CN); Edward John Thomas, Streetsboro, OH (US); Shuyi Qin, ShangHai (CN); Min Fang, ShangHai (CN); Honghao Wu, ShangHai (CN)

(73) Assignee: HLI SOLUTIONS, INC., Beachwood, OH (US)

( * ) Notice: Subject to any disclaimer, the term of this patent is extended or adjusted under 35 U.S.C. 154(b) by 250 days.

(21) Appl. No.: 17/261,349

(22) PCT Filed: Sep. 18, 2019

(86) PCT No.: PCT/CN2019/106328
§ 371 (c)(1),
(2) Date: Aug. 18, 2021

(87) PCT Pub. No.: WO2020/015766
PCT Pub. Date: Jan. 23, 2020

(65) Prior Publication Data

US 2022/0214031 A1 Jul. 7, 2022

(30) Foreign Application Priority Data

Jul. 20, 2018 (CN) ..... 201810802530.6

(51) Int. Cl.
*F21V 21/14* (2006.01)
*F21V 17/06* (2006.01)
*F21Y 115/10* (2016.01)

(52) U.S. Cl.
CPC ..... *F21V 21/14* (2013.01); *F21V 17/06* (2013.01); *F21Y 2115/10* (2016.08)

(58) Field of Classification Search
CPC ..... F21V 21/14; F21V 17/06; F21V 19/007; F21V 21/10; F21V 21/34; F21Y 2115/10; F21K 9/232; F21S 8/08
See application file for complete search history.

(56) References Cited

U.S. PATENT DOCUMENTS 2,963,255 A * 12/1960 Bobrick ..... F21S 8/02 248/327
4,727,460 A * 2/1988 Payne ..... F21V 21/28 362/269

(Continued)

FOREIGN PATENT DOCUMENTS

CN 203162868 U 8/2013
CN 103672672 A 3/2014

(Continued)

OTHER PUBLICATIONS

English Translation, CN 107035993, Aug. 11, 2017, Fang YE (Year: 2017).*

(Continued)

*Primary Examiner* — Peggy A Neils
(74) *Attorney, Agent, or Firm* — Buckley, Maschoff & Talwalkar LLC

(57) ABSTRACT

A support accessory is provided for an LED lamp, and the support accessory includes a frame and a supporting leg. The frame is configured to be detachably coupled to the LED lamp, and the supporting leg is configured for supporting the frame on at least one certain support surface when the LED lamp is installed. Wherein, in a first state, the supporting leg is fixed to the frame, and in a second state, the supporting leg is slidably coupled to the frame and can slide relative to the frame to adjust length of the supporting leg between the frame and the at least one certain support surface.

12 Claims, 10 Drawing Sheets

(56) References Cited

U.S. PATENT DOCUMENTS

| | | | | |
|---|---|---|---|---|
| 2015/0300612 | A1* | 10/2015 | Stathes | F21S 8/026 29/434 |
| 2018/0224095 | A1* | 8/2018 | Cohen | F21V 21/04 |

FOREIGN PATENT DOCUMENTS

| | | | | |
|---|---|---|---|---|
| CN | 106931410 | A | 7/2017 | |
| CN | 107035993 | * | 8/2017 | F21V 21/14 |
| CN | 206390623 | U | 8/2017 | |
| CN | 107238061 | A | 10/2017 | |
| CN | 206555764 | U | 10/2017 | |
| CN | 107477464 | A | 12/2017 | |
| CN | 206771280 | U | 12/2017 | |
| CN | 207005926 | U | 2/2018 | |
| CN | 107883352 | A | 4/2018 | |
| CN | 207621811 | U | 7/2018 | |
| EP | 3604914 | A1 | 2/2020 | |

OTHER PUBLICATIONS

International Search Report and Written Opinion dated Dec. 10, 2020 which was issued in connection with PCT/CN2019/106328 which was filed on Sep. 18, 2019 (Written Opinion in Chinese only). Office Action dated Mar. 19, 2021 which was issued in connection with Chinese Application No. 201810802530.6 which was filed on Jul. 20, 2018.

* cited by examiner

SUPPORT ASSEMBLY AND ILLUMINATION SYSTEM

BACKGROUND

Embodiments of the present disclosure relate generally to a support assembly, and more particularly relate to a support assembly for use in the lighting field.

Traditionally, high intensity discharge (HID) lighting sources are used for a wide array of lighting applications in public spaces such as stores, libraries, theatres and school gymnasiums, for example. The actions towards improved energy efficiency have brought about a state-of-the-art light emitting diode (LED) technology, which has been used as an alternative to HID lighting in commercial and municipal applications. LED lighting has the potential to provide improved energy efficiency and light output in various applications.

The LED lighting sources which are designed to replace the HID lighting sources, especially the high wattage lighting sources, are usually big in size and heavy in weight. As a result, when a LED lighting source is installed horizontally or angularly in a lighting fixture, it will bring a high torque force to the screw base used for connecting it to the lighting fixture. In current approaches, some supporting elements are fixed to the LED lighting source to support it. However, since the LED lighting sources may be installed in different kinds of lighting fixtures, different supporting elements may be required, which may lead to inventory pressures and relatively laborious operations.

Therefore, it is desirable to provide a support assembly to address one or more of the above-mentioned problems.

BRIEF DESCRIPTION

In accordance with one embodiment disclosed herein, a support accessory is provided for an LED lamp, and the support accessory includes a frame and a supporting leg. The frame is configured to be detachably coupled to the LED lamp, and the supporting leg is configured for supporting the frame on at least one certain support surface when the LED lamp is installed. Wherein, in a first state, the supporting leg is fixed to the frame, and in a second state, the supporting leg is slidably coupled to the frame and is slidable relative to the frame to adjust the support length of the supporting leg between the frame and the at least one certain support surface.

In accordance with another embodiment disclosed herein, a lighting system includes a cover, a transparent or translucent lens, an LED lamp and a support accessory. The LED lamp is coupled to the cover and accommodated in an inner cavity defined by the cover and the lens. The support accessory is coupled to the cover and accommodated in an inner cavity defined by the cover and the lens, and the support accessory includes a frame and a supporting leg. The frame is configured to be detachably coupled to the LED lamp, and the supporting leg is configured for supporting the frame on at least one certain support surface when the LED lamp is installed. Wherein, in a first state, the supporting leg is fixed to the frame, and in a second state, the supporting leg is slidably coupled to the frame and is slidable relative to the frame to adjust the support length of the supporting leg between the frame and the at least one certain support surface.

BRIEF DESCRIPTION OF THE DRAWINGS

The accompanying drawings, which are incorporated herein and form part of the specification, illustrate the present disclosure and, together with the description, further serve to explain the principles of the disclosure and to enable a person skilled in the relevant art(s) to make and use the disclosure.

DETAILED DESCRIPTION

Unless defined otherwise, technical and scientific terms used herein have the same meaning as is commonly understood by one of ordinary skills in the art to which this disclosure belongs. The terms "first", "second", and the like, as used herein, do not denote any order, quantity, or importance, but rather are used to distinguish one element from another. Also, the terms "a", and "an" do not denote a limitation of quantity, but rather denote the presence of at least one of the referenced items. The use of "including," "comprising" or "having" and their variations herein are meant to encompass the items listed thereafter and equivalents thereof as well as additional items. The terms "connected" and "coupled" are not restricted to physical or mechanical connections or couplings, and can include electrical connections or couplings, whether direct or indirect. The terms "component", "module", "system", "interface", or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer.

Figure 1:
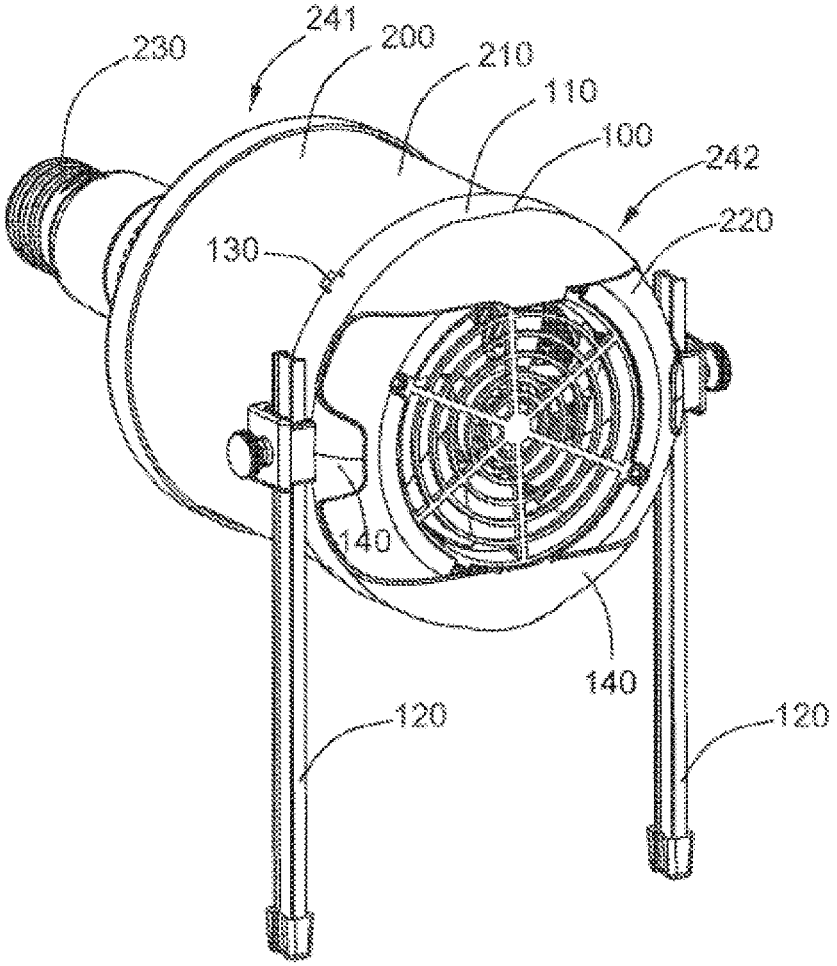
FIG. 1 is a perspective view of an exemplary support accessory in connection with a LED lamp, in accordance with the aspects described herein.
Figure 2:
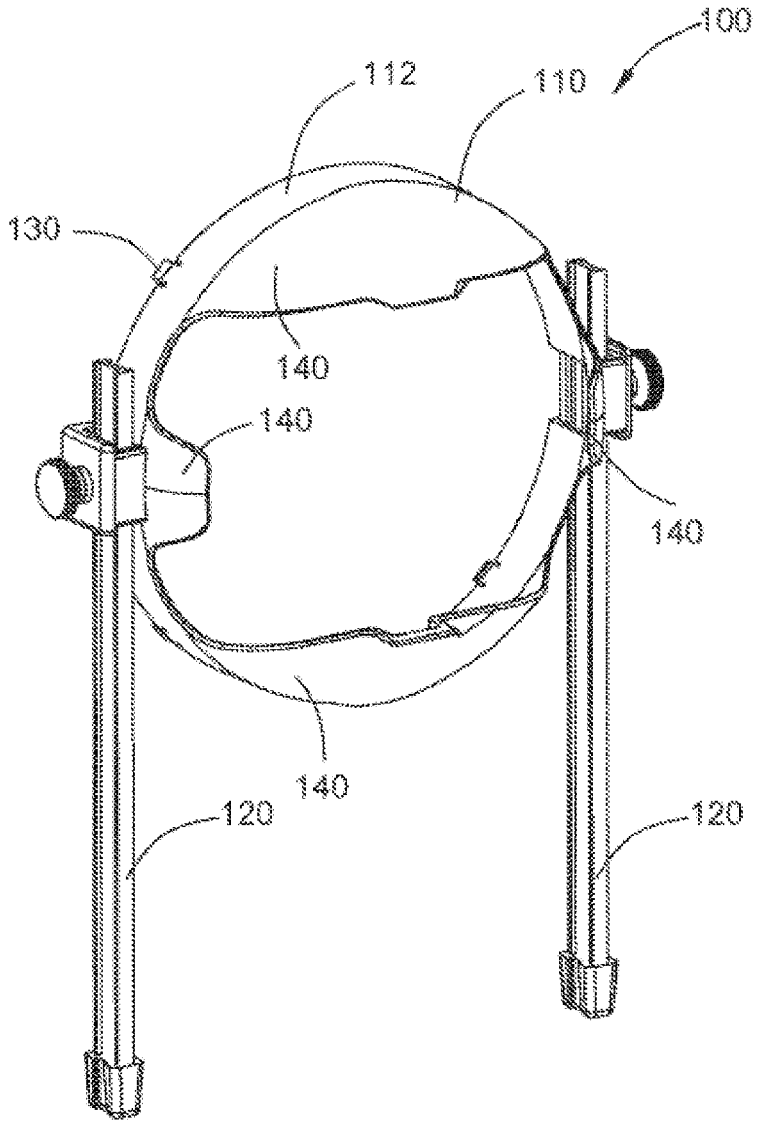
FIG. 2 is a perspective view of the support accessory of FIG. 1 in accordance with the aspects described herein.
Figure 3:
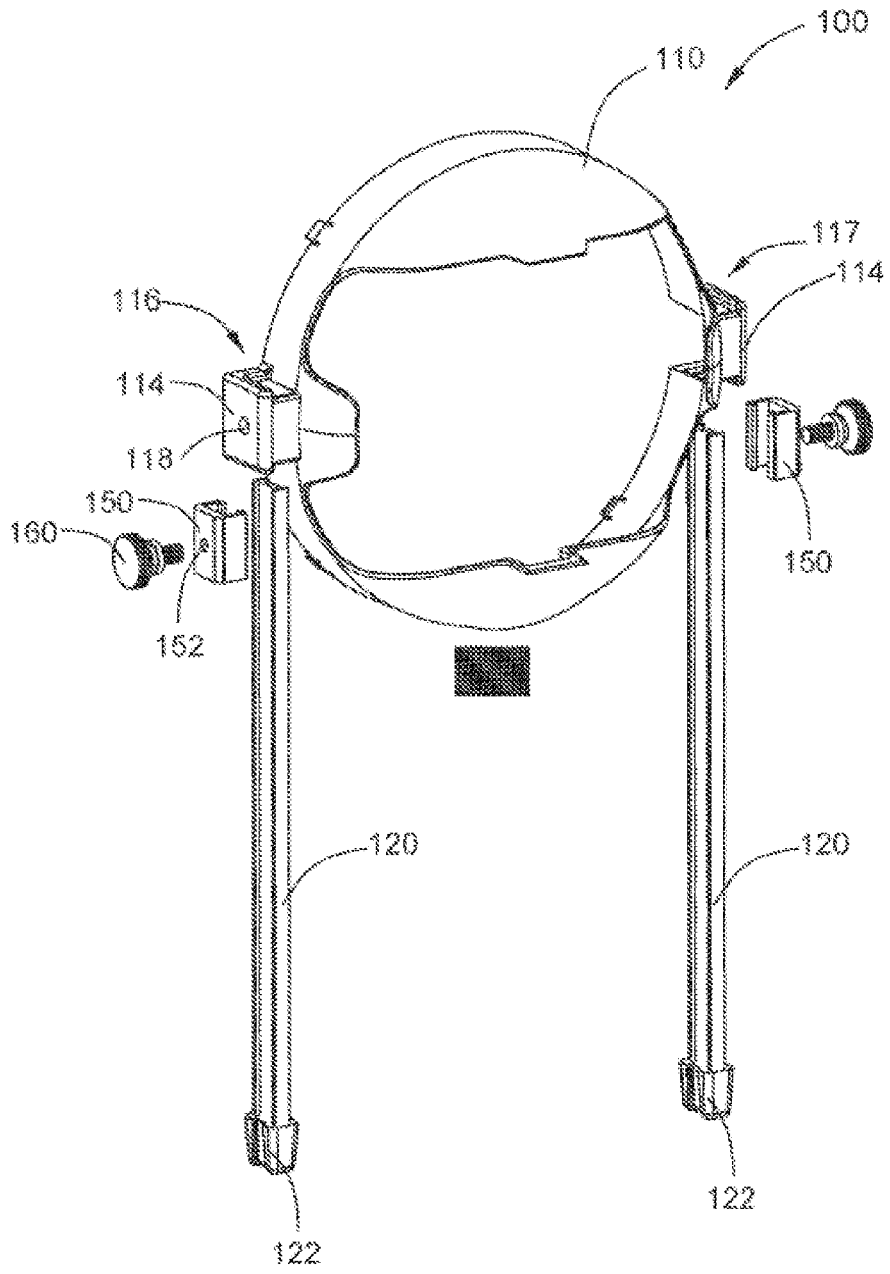
FIG. 3 is an exploded view of the support accessory of FIG. 1 in accordance with the aspects described herein.

FIG. 1 is a perspective view of a connector assembly 100 in connection with a LED lamp 200. FIG. 2 is a perspective view of the support accessory 100 of FIG. 1. FIG. 3 is an exploded view of the support accessory 100 of FIG. 1. The supporting accessory 100 includes a frame 110 and two supporting legs 120. The frame 110 is detachably coupled to the LED lamp 200, and the two supporting legs 120 is configured for supporting the frame 110 and the LED lamp 200 on at least one certain support surface (such as an inner surface 705 shown in FIG. 7) when the LED lamp 200 is installed. In a first state, the supporting leg 120 is fixed to the frame 110, and in a second state, the supporting leg 120 is slidably coupled to the frame 110 and is slidable relative to the frame 110 to adjust a support length of the supporting leg 120 between the frame 110 and the at least one certain support surface. The support length is the distance between the certain support surface and a junction of the supporting leg 120 and the frame 100.

The type and structure of the LED lamp are not limited herein. In some embodiments, the LED lamp 200 includes a main house 210, a base 230 and a front cover 220. The main house 210 has opposite ends 241 and 242, with the end 241 coupled to the base 230 and the end 242 as a free end. The front cover 220 is coupled to the free end 242 of the LED lamp 200.

In some embodiments, the frame 110 is detachably coupled to the front cover 220 of the LED lamp 200 via at least one clip 130 and at least one position module 140. As shown in FIG. 1 and FIG. 2, the frame 110 has a circular ring 112, and the at least one position module 140 extending from the circular ring 112 is configured to cover at least part of the front cover 220. The at least one clip 130 is approximately uniformly distributed around a periphery of the circular ring 112 and configured to clamp the LED lamp 200. In this embodiment, four clips 130 which are integrally formed with the circular ring 112 are configured to clamp the front cover 220 of the LED lamp 200. Four position modules 140 are approximately uniformly distributed around the periphery of the circular ring 112, and the position modules 140 are integrally formed with the frame 110. The position modules may be different in size and shape. In some other embodiments, the frame 110 may be integrally formed with the LED lamp 200, or the front cover of the LED lamp 200 may be deemed as the frame and the frame is detachably coupled to the free end 242 of the LED lamp 200.

In some embodiments, the frame 110 with at least one clip 130 and at least one position module 140 is made of a plastic material, and it can be detachably coupled to the LED lamp 200 quickly and easily without impacting the light output.

FIG. 3 is an exploded view of the support accessory 100 of FIG. 1. The frame 110 further includes at least one protrusion 114, and each protrusion 114 defines a cavity 116. The supporting leg 120 is partially accommodated in the cavity 116, in a manner that the supporting leg 120 passes through the cavity 116 when the supporting leg 120 slides relative to the frame 110. In some embodiments, the support accessory 100 further includes a sliding guide 150 at least partially accommodated in the cavity 116, and the supporting leg 120 is partially accommodated in the sliding guide 150 and slidable along the sliding guide 150 in the second state.

Figure 7:
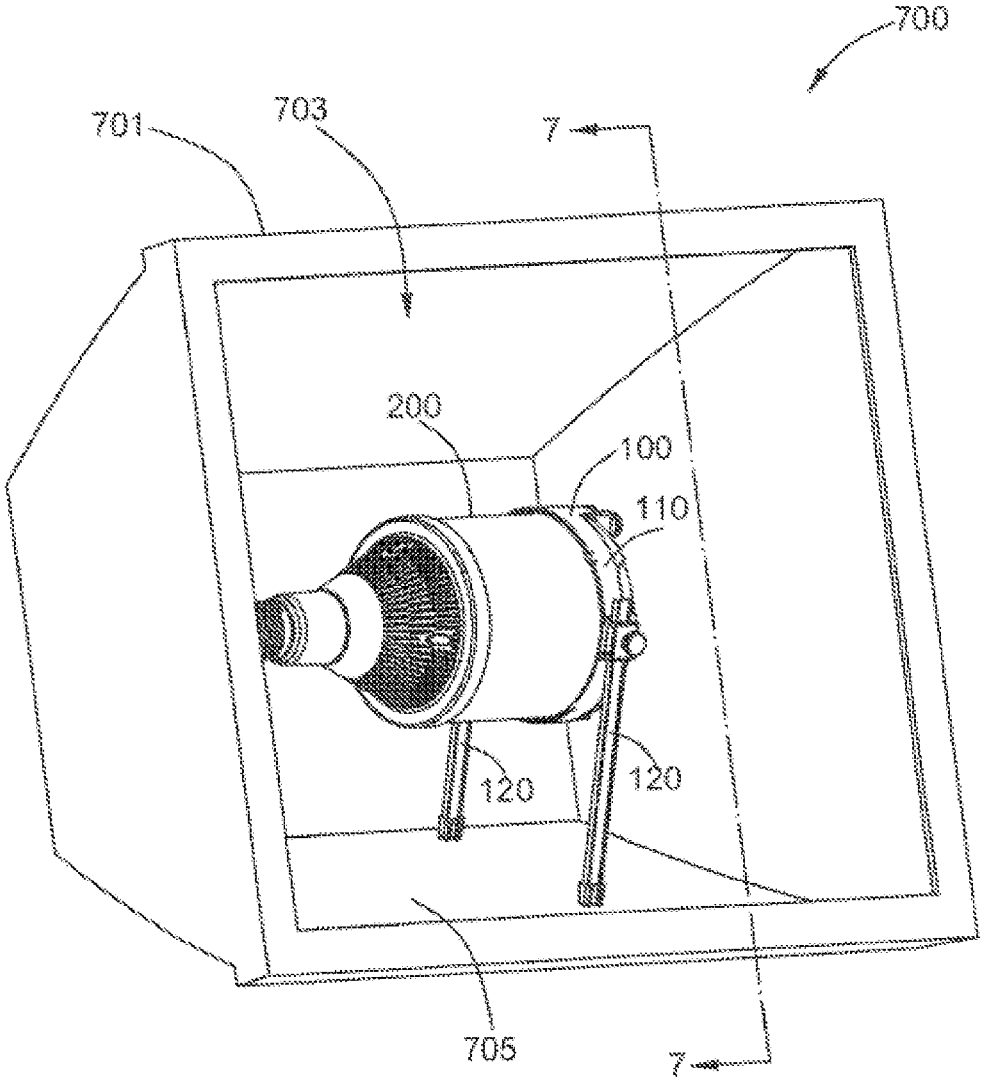
FIG. 7 is a perspective view of an exemplary lighting system in accordance with the aspects described herein.

In some embodiments, the supporting leg 120 and the sliding guide 150 are made of light metal materials, such as Aluminum, via an extrusion process. And the supporting leg 120 includes a rubber cushion 122 at an end thereof, for attaching to the at least one certain support surface (as shown in FIG. 7) and for avoiding damage to the certain support surface.

In some embodiments, the support accessory 100 further includes a fastener 160 used to fix the supporting leg 120 relative to the frame 110 in the first state, and unfix the supporting leg 120 from the frame 110 in the second state. In the first state, the fastener 160 extends into the cavity 116 through a first hole 118 of the frame 110 and a second hole 152 of the sliding guide 150, and presses the supporting leg 120 against the frame 110. And in the second state, the fastener 160 releases the supporting leg 120 such that the supporting leg 120 can slide relative to the frame 110 to adjust the support length.

In some embodiments, as shown in FIG. 3, the frame 110 includes two protrusions 114 defining a first cavity 116 and a second cavity 117, respectively. The first cavity 116 and the second cavity 117 are distributed on the lateral sides of the frame 110, respectively. The two supporting legs 120 pass through the first cavity 116 and the second cavity 117, respectively, when the supporting legs 120 slide relative to the frame 110. In some embodiments, the two supporting legs 120 are approximately parallel to each other. And in some other embodiments, with the structure of the protrusions 114 adjusted, the two supporting legs 120 may form an angle.

Figure 4:
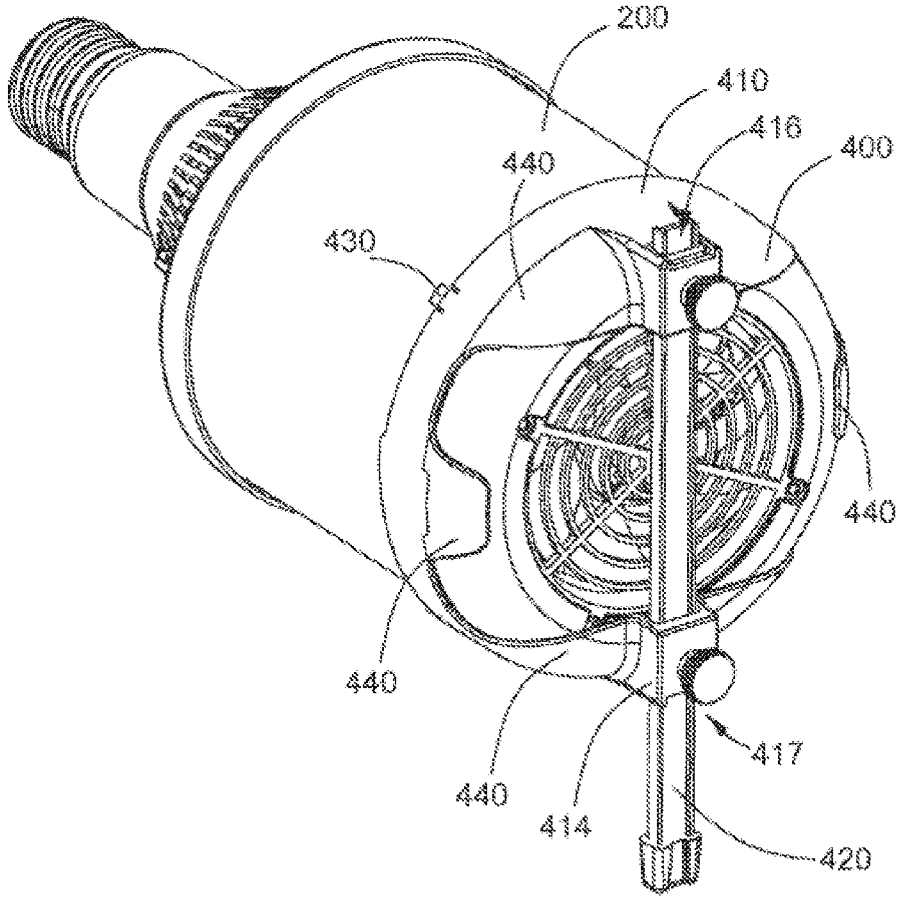
FIG. 4 is a perspective view of another exemplary support accessory in connection with the LED lamp, in accordance with the aspects described herein.

FIG. 4 is a perspective view of another exemplary support accessory 400 in connection with the LED lamp 200. The support accessory 400 includes a frame 410 which is similar with the frame 110 in FIG. 1. A difference between the frame 410 and the frame 110 is that the frame 410 includes two protrusions 414 defining a first cavity 416 and a second cavity 417, respectively, and the first cavity 416 and the second cavity 417 are aligned with each other such that a support leg 420 is able to pass through both the first cavity 416 and the second cavity 417 when the supporting leg 420 slides relative to the frame 410. In some embodiments, the two protrusions 414 are mounted on two position modules 440 that are symmetrical with respect to the axis of the LED lamp 200, respectively.

Figure 5:
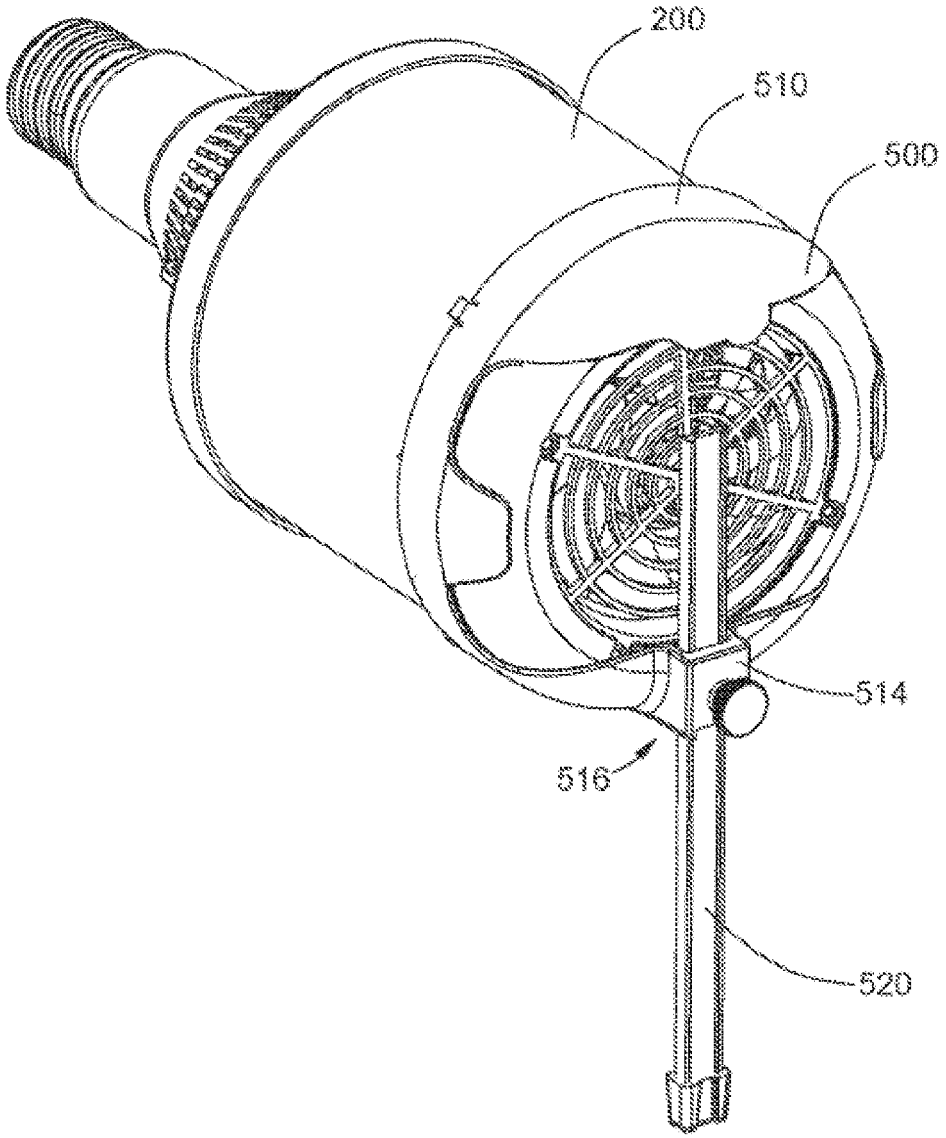
FIG. 5 is a perspective view of a yet another exemplary support accessory in connection with the LED lamp, in accordance with the aspects described herein.

FIG. 5 is a perspective view of yet another exemplary support accessory 500 in connection with the LED lamp 200. The support accessory 500 includes a frame 510 that is similar with the frame 410 of FIG. 4. One difference between the frame 510 and the frame 410 is that the frame 510 includes one protrusion 514 defining a first cavity 516, and the support leg 520 passes through the first cavity 516 when the supporting leg 520 slides relative to the frame 510.

Figure 6:
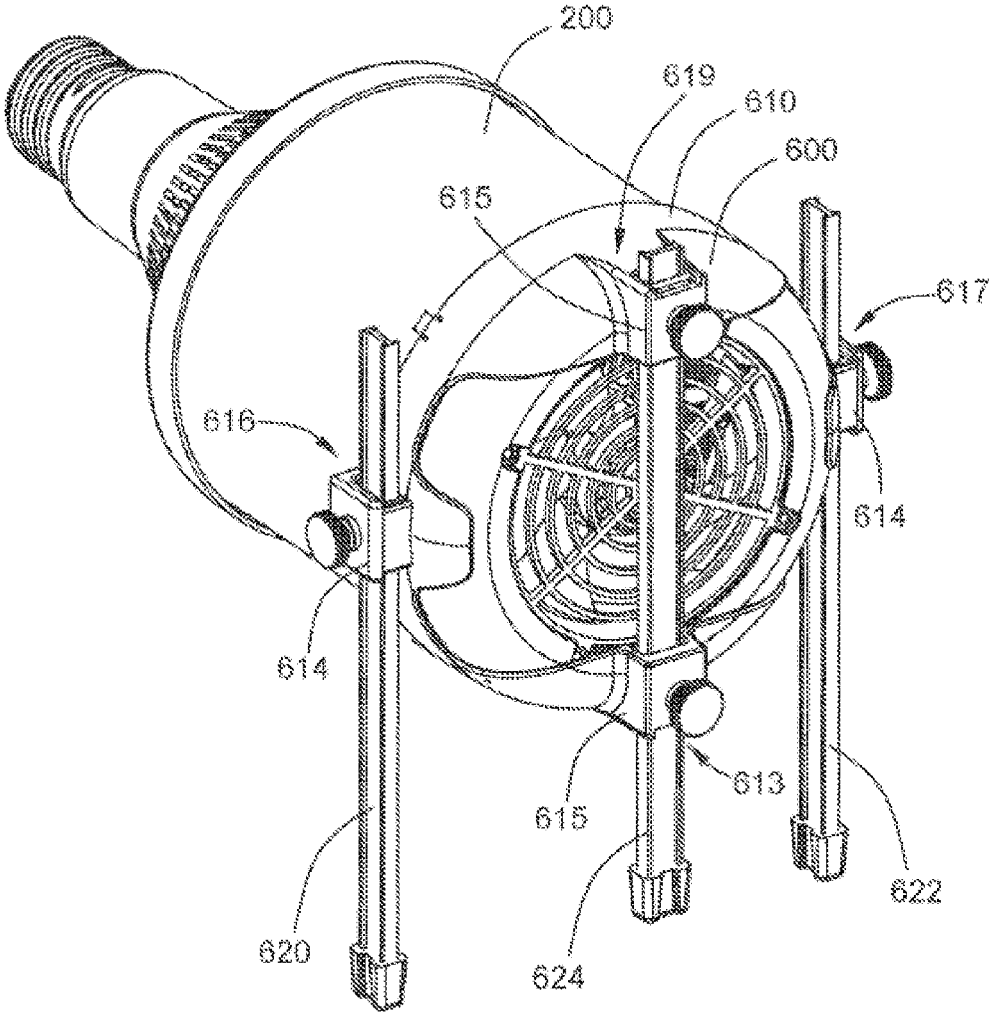
FIG. 6 is a perspective view of a yet another exemplary support accessory in connection with the LED lamp, in accordance with the aspects described herein.

FIG. 6 is a perspective view of yet another exemplary support accessory 600 in connection with the LED lamp 200. The support accessory 600 includes a frame 610 that includes two first protrusions 614 and two second protrusions 615. The two first protrusions 614 define a first cavity 616 and a second cavity 617 distributed on the lateral sides of the frame 610, respectively. A supporting leg 620 passes through the first cavity 616 when the supporting leg 620 slides relative to the frame 610, and the support accessory 600 further includes an additional supporting leg 622 that passes through the second cavity 617 when the additional supporting leg 622 slides relative to the frame 610. The two second protrusions 614 define a third cavity 619 and a fourth cavity 613, respectively. The third cavity 619 and fourth cavity 613 are aligned with each other such that a support leg 624 can pass through both the third cavity 619 and the fourth cavity 613 when the supporting leg 624 slides relative to the frame 610.

Figure 8:
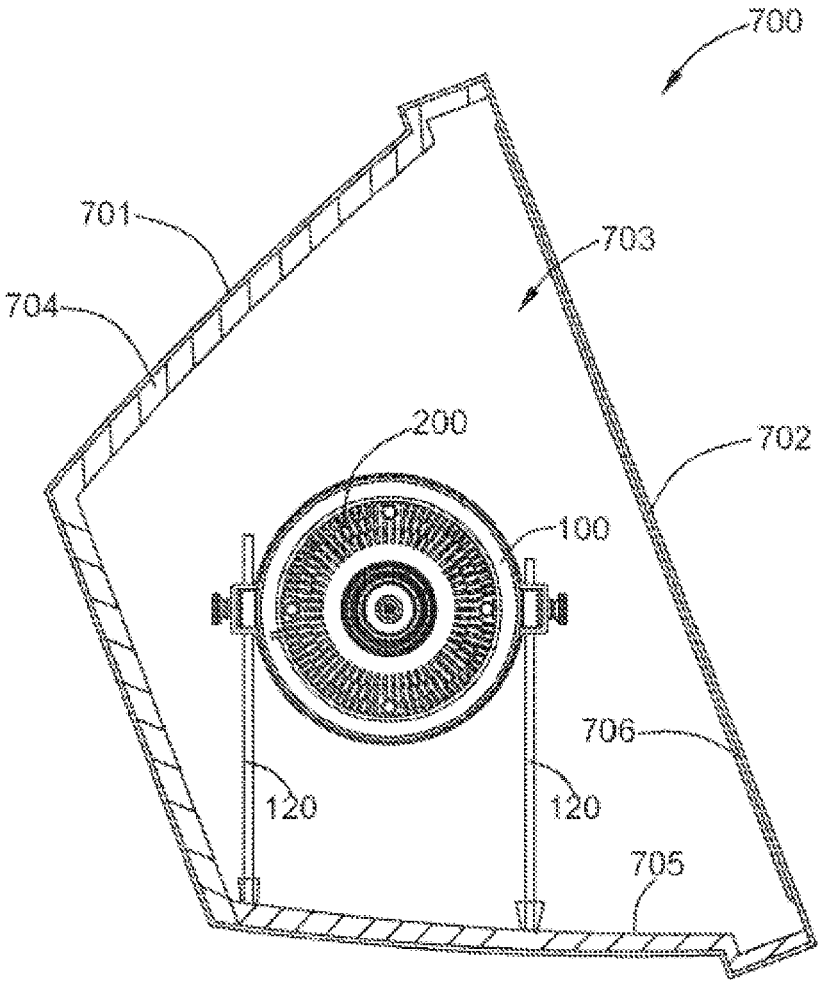
FIG. 8 is a cross-section view taken along line 7-7 in FIG. 7.

FIG. 7 is a perspective view of an exemplary lighting system 700. FIG. 8 is a cross-section view taken along the mid-line 7-7 in FIG. 7. The lighting system 700 includes a cover 701 (also called a lighting fixture), a transparent or translucent lens 702, and the LED lamp 200 and supporting accessory 100 shown in FIG. 1. Further referring to FIG. 1, the base 230 of the LED lamp 200 is coupled to the cover 701 and accommodated in an inner cavity 703 defined by the cover 701 and the lens 702. When the LED lamp 200 is installed horizontally or angularly in the cover 701, the heavy LED lamp, for example, a 1.0~2.0 kg LED lamp, will bring a high torque force to the base 230 of the LED lamp 200. The support accessory 100 is coupled to the free end 242 of the LED lamp 200 and configured to support the LED lamp 200. In some embodiments, the lighting system 700 further includes a reflector 704 configured to direct light from the LED lamp 200.

In some embodiments, as shown in FIG. 3, FIG. 7 and FIG. 8, before the LED lamp 200 is installed into the cover 701, the frame 110 is detachably coupled to the LED lamp 200. In the second state, the supporting legs 120 passes through the first cavity 116 and the second cavity 117, respectively, and each supporting leg 120 is partially accommodated in the sliding guide 150 of the cavity. When the LED lamp 200 is installed in the cover 701, the supporting legs 120 slide relative to the frame 110 to adjust the support length of the supporting legs 120 between the frame 110 and the at least one certain support surface. In the first state, immediately after the supporting legs 120 have been attached to the at least one certain support surface to support the frame 110 and the LED lamp 200, the supporting legs 120 are fixed to the frame 110, for example, via the fastener 160. The certain support surface may be the surface of a component or device surrounding the LED lamp 200 and the support accessory. For example, the certain support surface may be any inner surface 705 of the cover 701 or an inner surface 706 of the lens 702. As the inner surface 705 of the cover 701 may not be a flat surface or the LED lamp 200 may be installed angularly in the cover 701, the supporting lengths of the two supporting legs may be different. The support accessory 100 that has an adjustable supporting length may be flexible enough to adapt itself to different lighting systems for different applications.

Figure 9:
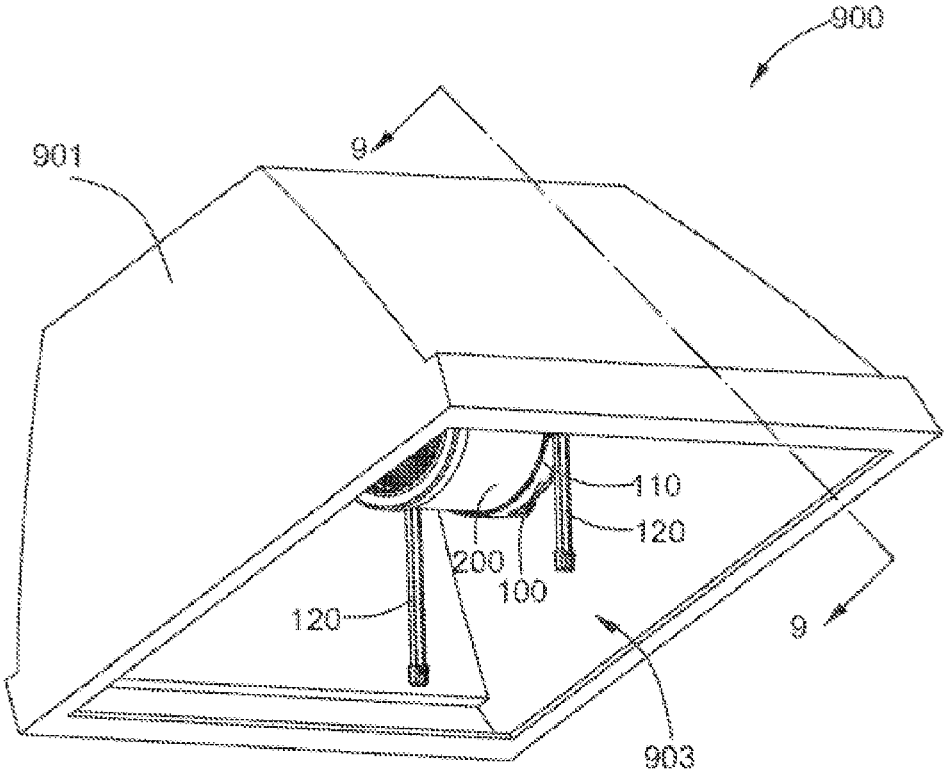
FIG. 9 is a perspective view of another exemplary lighting system in accordance with the aspects described herein.
Figure 10:
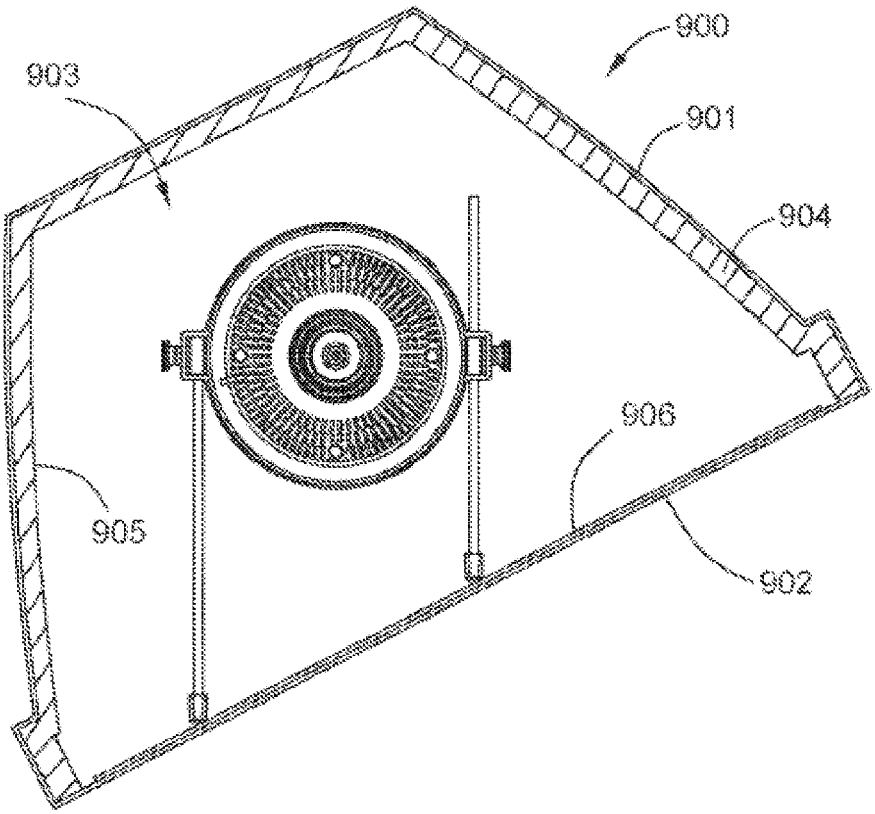
FIG. 10 is a cross-section view taken along line 9-9 in FIG. 9.

FIG. 9 is a perspective view of another exemplary lighting system 900. FIG. 10 is a cross-section view taken along the midline 9-9 in FIG. 9. The lighting system 900 includes a cover 901, a transparent or translucent lens 902, a reflector 904, and the LED lamp 200 and the supporting accessory 100 shown in FIG. 1. Further referring to FIG. 1, the base 230 of the LED lamp 200 is coupled to the cover 901 and accommodated in an inner cavity 903 defined by the cover 901 and the lens 902. When the LED lamp 200 is installed in the cover 901, the supporting legs 120 slide relative to the frame 110 to adjust the support lengths of the supporting legs 120 between the frame 110 and the at least one certain support surface. In the first state, immediately after the supporting legs 120 have been attached to the at least one certain support surface to support the frame 110 and the LED lamp 200, the supporting legs 120 are fixed to the frame 110, for example, via the fastener 160. The certain support surface is an inner surface 906 of the lens 902. In some other embodiments, the supporting legs 120 may be supported by both of an inner surface 905 of the reflector 904 and the inner surface 906 of the lens 902.

In some embodiments, the supporting accessory shown in FIGS. 4-6 may also be quickly installed and easily adjusted in the aforementioned lighting system.

The support accessory of this disclosure is designed to include the frame with clips and position modules, and can be quickly and easily attached to the LED lamp. The metal supporting legs made via an extrusion process are strong enough to support the LED lamps, and the supporting legs with adjustable supporting lengths can help the supporting accessory adapt itself to all kinds of lighting systems.

The extent of patent protection for this application is defined by the claims, and the patent protection may also cover other embodiments that could be thought of by those skilled in the art. If the structural elements contained in those other embodiments are not different to what has been described in the claims, or the equivalent structural elements contained in those other embodiments are only insubstantially different to what has been described in the claims, these other embodiments shall fall within the scope of the appended claims. t Various replacements and specific embodiments are expected to fall within the scope of the appended claims, which specifically point out and clearly declare the subject matter of the application.

The invention claimed is:

1. A support accessory for an LED lamp, comprising:

a frame comprising a circular ring and a plurality of position modules extending from the circular ring, wherein the circular ring is configured to be detachably coupled to the LED lamp and wherein the position modules are distributed around the periphery of the circular ring; and at least one supporting leg for supporting the frame on at least one certain support surface when the LED lamp is installed, wherein, in a first state, the at least one supporting leg is fixed to the frame, and in a second state, the at least one supporting leg is slidably coupled to the frame and is slidable relative to the frame to adjust a support length of the supporting leg between the frame and the at least one certain support surface.

2. The support accessory according to claim 1, further comprising a fastener configured to fix the supporting leg relative to the frame in the first state, and unfix the supporting leg from the frame in the second state.

3. The support accessory according to claim 1, wherein the frame defines a cavity, the supporting leg is partially accommodated in the cavity, in a manner that the supporting leg passes through the cavity when the supporting leg slides relative to the frame.

4. The support accessory according to claim 3, further comprising a sliding guide at least partially accommodated in the cavity, wherein the supporting leg is slidable along the sliding guide in the second state.

5. The support accessory according to claim 4, further comprising a fastener extending into the cavity through a first hole of the frame and a second hole of the sliding guide, to press the supporting leg to the frame in the first state, wherein the fastener releases the supporting leg in the second state.

6. The support accessory according to claim 3, wherein the frame defines a first cavity and a second cavity aligned with each other such that the supporting leg is able to pass through both the first cavity and the second cavity when the supporting leg slides relative to the frame.

7. The support accessory according to claim 3, wherein the frame defines a first cavity and a second cavity distributed on lateral sides of the frame, respectively, and the supporting leg passes through the first cavity when the supporting leg slides relative to the frame, and wherein the support accessory further comprises an additional supporting leg that passes through the second cavity when the additional supporting leg slides relative to the frame.

8. The support accessory according to claim 1, wherein the frame is detachably coupled to a free end of the LED lamp near the front cover via at least one clip.

9. The support accessory according to claim 8, wherein the at least one clip is configured to clamp the LED lamp, and the at least one position module is integrally formed with the frame.

10. The support accessory according to claim 1, wherein the supporting leg comprises a rubber cushion at an end thereof, for attaching to the at least one certain support surface.

11. A lighting system, comprising a cover;

a transparent or translucent lens;

an LED lamp coupled to the cover and accommodated in an inner cavity defined by the cover and the lens; and a support accessory coupled to the LED lamp and configured to hold the LED lamp, the support accessory comprising:

a frame comprising a circular ring and a plurality of position modules extending from the circular ring, wherein the circular ring is configured to be detachably coupled to the LED lamp and wherein the position modules are distributed around the periphery of the circular ring; and at least one supporting leg for supporting the frame on at least one certain support surface when the LED lamp is installed, wherein, in a first state, the at least one supporting leg is fixed to the frame, and in a second state, the at least one supporting leg is slidably coupled to the frame and is slidable relative to the frame to adjust a support length of the supporting leg between the frame and the at least one certain support surface.

12. The lighting system according to claim 11, wherein the supporting leg is configured to hold the LED lamp on the at least one certain support surface of at least one of the cover and the lens.

* * * * *